US006378446B1

(12) United States Patent
Long

(10) Patent No.: US 6,378,446 B1
(45) Date of Patent: Apr. 30, 2002

(54) COUNTERBALANCE APPARATUS

(76) Inventor: Dennis L. Long, 2161 Thornapple River Dr., Grand Rapids, MI (US) 49546

( * ) Notice: Subject to any disclaimer, the term of this patent is extended or adjusted under 35 U.S.C. 154(b) by 0 days.

(21) Appl. No.: 09/752,012

(22) Filed: Dec. 29, 2000

Related U.S. Application Data

(60) Provisional application No. 60/173,782, filed on Dec. 30, 1999.

(51) Int. Cl.[7] ..... A47B 9/00

(52) U.S. Cl. ..... 108/147; 248/162.1; 248/404

(58) Field of Search ..... 108/147, 144, 108/106, 147.19; 248/188.2, 188.5, 162.1, 404

(56) References Cited

U.S. PATENT DOCUMENTS

| | | | | |
|---|---|---|---|---|
| 300,887 A | | 6/1884 | Owen | |
| 424,711 A | | 4/1890 | Homan | |
| 484,707 A | | 10/1892 | Garee | |
| 660,868 A | | 10/1900 | Reid | |
| 2,649,345 A | | 8/1953 | Hubbard | |
| 2,918,273 A | | 12/1959 | Whisler et al. | |
| 3,543,282 A | | 11/1970 | Sautereau | |
| 3,582,059 A | | 6/1971 | Van Ooy | |
| 3,845,926 A | | 11/1974 | Wahls | |
| 3,885,764 A | | 5/1975 | Pabreza | |
| 4,130,069 A | | 12/1978 | Evans et al. | |
| 4,156,391 A | | 5/1979 | Ubezio | |
| 4,183,689 A | | 1/1980 | Wirges et al. | |
| 4,351,245 A | | 9/1982 | Laporte | |
| 4,381,714 A | | 5/1983 | Henneberg et al. | |
| 4,415,135 A | | 11/1983 | French | |
| 4,619,208 A | | 10/1986 | Kurrasch | |
| 4,625,657 A | | 12/1986 | Little et al. | |
| 4,651,652 A | | 3/1987 | Wyckoff | |
| 5,243,921 A | | 9/1993 | Kruse et al. | |
| 5,311,827 A | | 5/1994 | Greene | |
| 5,322,025 A | | 6/1994 | Sherman et al. | |
| 5,337,678 A | * | 8/1994 | Grout | 108/147 |
| 5,400,721 A | | 3/1995 | Greene | |
| 5,443,017 A | | 8/1995 | Wacker et al. | |
| 5,456,191 A | | 10/1995 | Hall | |
| 5,513,825 A | | 5/1996 | Gutgsell | |
| 5,553,550 A | * | 9/1996 | Doyle | 108/147 X |
| 5,598,788 A | * | 2/1997 | Jonker | 108/147 |
| 5,718,406 A | | 2/1998 | Long | |
| 5,819,669 A | * | 10/1998 | Eyre | 108/147 |
| 6,026,755 A | | 2/2000 | Long | |

FOREIGN PATENT DOCUMENTS

| | | |
|---|---|---|
| GB | 281884 | 12/1927 |

* cited by examiner

*Primary Examiner*—Jose V. Chen
(74) *Attorney, Agent, or Firm*—Mary M. Moyne; Ian C. McLeod

(57) ABSTRACT

A counterbalance apparatus (10) for moving the work surface (100B) of a work station (100) including outer and inner members (12 and 20) having outer and inner inserts (16 and 26) with outer and inner cam surfaces (16B and 26B). A dampener (30) having a threaded rod (36) is mounted within the inner member. A cam follower (50) is mounted on the dampener such that the rollers (54) are in contact with the outer and inner cam surfaces. Springs (69, 70 and 71) are mounted between the cam follower and an adjustment nut (42) around the dampener. As the work surface moves, the inner member moves in and out of the outer member to compress and expand the springs. The cam rollers move along the cam surfaces and allow for a constant force on the work surface throughout the movement of the work station.

31 Claims, 7 Drawing Sheets

COUNTERBALANCE APPARATUS

CROSS-REFERENCE TO RELATED APPLICATIONS

This application is based upon Provisional Application Ser. No. 60/173,782 filed Dec. 30, 1999.

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION (1) Field of the Invention

The present invention relates to an improved counterbalance apparatus for use in moving a work surface. In particular, the present invention relates to an improved counterbalance apparatus for vertically moving the work surface of a work station where the counterbalance apparatus exerts a constant force on the moving work surface.

(2) Description of the Related Art

Applicant's Pat. Nos. 5,718,406 and 6,026,755 describe counterbalance apparatuses which apply a constant force on the work surface while the work surface is moving. The apparatus includes inner and outer members having inner and outer cam grooves. The apparatuses also have a dampener around which is mounted a spring. A cam follower having inner and outer cam rollers is connected to one end of the dampener. As the apparatuses are extended and compressed to raise and lower the work surface, the inner member moves in and out of the outer member which expands and compresses the spring. In addition, the inner rollers of the cam follower move along the inner grooves of the inner member and the outer cam rollers move along the outer grooves of the outer member. The cam rollers of the cam follower move together as a single unit. The cam rollers remain in their respective positions on the cam follower as the cam follower moves along the grooves in the inner and outer members.

Other related art has shown various systems and mechanisms for vertically adjusting work surfaces or table tops. Illustrative are U.S. Pat. No. 484,707 to Garee; U.S. Pat. No. 2,649,345 to Hubbard; U.S. Pat. No. 4,130,069 to Evans et al; U.S. Pat. No. 4,183,689 to Wirges et al; U.S. Pat. No. 4,381,714 to Henneberg et al; U.S. Pat. No. 4,619,208 to Kurrasch; U.S. Pat. No. 4,651,652 to Wyckoff; U.S. Pat. No. 5,243,921 to Kruse et al; U.S. Pat. No. 5,322,025 to Sherman et al; U.S. Pat. No. 5,443,017 to Wacker et al and U.S. Pat. No. 5,456,191 to Hall.

In addition, U.S. Pat. Nos. 5,400,721 and 5,311,827 both to Greene show a load compensator for a spring counterweight mechanism which includes a snail cam.

U.S. Pat. No. 660,868 to Reid shows a counterbalance system for a table top which uses a chain and pulley with a weight. Similarly, U.S. Pat. No. 3,543,282 to Sautereau describes a drawing board having a counterbalance mechanism which includes pulleys and cables and which allows for easier vertical movement of the drawing board. U.S. Pat. No. 4,156,391 to Ubezio describes a counterbalance apparatus for table tops which uses a leaf spring as the means for providing the counterbalancing force. U.S. Pat. No. 4,351,245 to Laporte describes a counterweight system which uses cables and pulleys in combination with a cam mechanism.

Also, of some interest are U.S. Pat. No. 2,918,273 to Whisler et al and U.S. Pat. No. 3,582,059 to Van Ooy. Whisler et al shows a control device for a spring. Van Ooy describes a shock absorber where the wire of the compression spring is provided with one or more roller shaped guide members coaxial with the wire and rotatable about it. The guide members around the compression spring substantially eliminate wear and noise owing to sliding friction.

Only of minimal interest are U.S. Pat. No. 300,887 to Owen; U.S. Pat. No. 424,711 to Homan; U.S. Pat. No. 3,845,926 to Wahls; U.S. Pat. No. 3,885,764 to Pabreza; U.S. Pat. No. 4,415,135 to French; U.S. Pat. No. 4,625,657 to Little et al and U.S. Pat. No. 5,513,825 to Gutqsell. Owen shows an adjustable trestle for supporting scaffolding. Homan shows an extendable lamp standard. Wahls shows a seat pedestal which uses a vertically extending double telescoping tube to raise and lower the seat. The pedestal also includes a toggle linkage locking mechanism for locking the pedestal at a given height.

Pabreza describes a telescoping seat pedestal which uses an elastomer block as a locking means. French describes a device for supporting a chair seat which uses a hydraulic cylinder. The hydraulic cylinder uses the flow of fluid to control the raising and lowering of the seat and the lack of fluid flow to lock the seat in place. Little et al shows a retractable keyboard support. Gutqsell shows a telescopic adjustable height apparatus having a locking means.

Also of some interest is United Kingdom Patent No. 281,884 to Coppock which shows a folding table having an adjustable height.

There remains the need for a counterbalance mechanism which is easy and inexpensive to manufacture and which provides a constant output force throughout the entire range of load on the work surface throughout the total travel of the work surface.

SUMMARY OF THE INVENTION

The present invention is a counterbalance apparatus for use in raising and lowering work surfaces or table tops. The counterbalance apparatus includes an outer member and an inner member telescopingly mounted together such that the inner member slides in and out of the open top of the outer member. The inner surface of the outer member is provided with an insert having outer cam surfaces and guide surfaces. The inner surface of the inner member is provided with an insert having inner cam surfaces and secondary surfaces. An inner roller mechanism having a torque compensation roller and an anti-cantilever roller is mounted on the bottom end of the inner member. The torque compensation rollers move along the guide edges of the outer insert and prevent the inner member from rotating as it moves into and out of the outer member. The anti-cantilever roller contacts the sidewall of the outer member if the inner member tilts in the outer member usually due to a unequal placement of the load on the work surface. The apparatus also has a dampener with three (3) springs which mount around the dampener. A rotatable cam follower having cam rollers is mounted at the bottom end of the dampener. The springs extend between the cam follower and an adjustment nut at the top end of the dampener. The springs are preferably non-linear and compensate for the weight of the work surface and any load on the work surface. The adjustment nut allows for adjusting the compression of the springs and then the initial force exerted by the springs based on the weight of the work surface and load. As the inner member moves in and out of the outer member, the cam follower rotates such that the cam rollers follow along the cam surfaces of the inner and outer cam inserts. The apparatus also includes an anti-racking mechanism which uses two (2) spools of steel wrap to ensure that when two (2) counterbalance apparatus are used the apparatus raise and lower the work surface in unison. The counterbalance apparatus can be mounted in one or as many legs as necessary to adequately raise the work surface. If more than one counterbalance is used then the counterbalance apparatus are preferably connected together such that the apparatuses raise and lower the work surface in unison. The counterbalance apparatus allows for vertical movement of the work surface at a constant force through the entire range of movement even when there is a load on the table top. The counterbalance apparatus allows for adjustment of the initial preload force on the apparatus to compensate for the amount of load on the work surface without changing the amount of force needed to move the work surface. The counterbalance mechanism is inexpensive to manufacture and durable and easy to use.

The present invention relates to a counterbalance apparatus, the improvement which comprises: a first tubular member defining a longitudinal axis and having a first end and a second end with at least one wall between the ends which forms the tubular member having an inner cavity, wherein a first cam surface is provided on the wall in the inner cavity and is inclined with respect to the longitudinal axis of the first tubular member; a second tubular member slidably mounted in the first tubular member so as to be along the longitudinal axis and having a first end and a second end and at least one wall between the ends forming an inner cavity, wherein a second cam surface is provided on at least one wall in the inner cavity of the second tubular member along the axis and is inclined with respect to the longitudinal axis of the first tubular member, wherein the first and second cam surfaces are oppositely inclined with respect to the longitudinal axis and wherein at least one of the second or first tubular members is movable along the longitudinal axis relative to the other of the tubular members to move the tubular members together; cam follower means mounted on and between the first and second cam surfaces, wherein the cam follower means moves on both cam surfaces simultaneously as the tubular members are moved together; and resilient means having opposed ends and mounted along and around the longitudinal axis of the tubular members so as to bias the tubular members apart and wherein the resilient means is shortened in length between the ends when the tubular members are moved together.

Further, the present invention relates to a work station with a counterbalance movable work surface and a support means for the work surface with a counterbalance apparatus between the support means and the work surface for the movement which comprises: the counterbalance apparatus including a first tubular member defining a longitudinal axis and having a first end and a second end with at least one wall between the ends which forms the tubular member, wherein a first cam surface is provided on the wall and is inclined with respect to the longitudinal axis of the first tubular member; a second tubular member slidably mounted in the first tubular member so as to be along the axis and having a first end and a second end and at least one wall between the ends, wherein a second cam surface is provided on the wall along the axis and is inclined with respect to the longitudinal axis of the first tubular member, wherein the first and second cam surfaces are oppositely inclined with respect to the longitudinal axis and wherein at least one of the second or first tubular members is movable along the longitudinal axis relative to the other of the tubular members to move the tubular members together; cam follower means mounted on and between the first and second cam surfaces, wherein the cam follower means moves on both cam surfaces simultaneously as the tubular members are moved together; and resilient means with opposed ends which are mounted along and around the longitudinal axis of the first tubular member so as to bias the tubular members apart and which is shortened in length between the ends of the resilient means when the tubular members are moved together; and locking means for securing the work surface of the work station against movement.

Still further, the present invention relates to a counterbalance apparatus, the improvement which comprises: a first tubular member defining a longitudinal axis and having a first end and a second end with at least one wall between the ends which forms the tubular member having an inner cavity, wherein a first cam surface is provided on at least one wall in the inner cavity and is inclined with respect to the longitudinal axis of the first tubular member; a second tubular member slidably mounted in the first tubular member so as to be along the axis and having a first end and a second end and at least one wall between the ends forming an inner cavity, wherein a second cam surface is provided on at least one wall in the inner cavity of the second tubular member along the axis and is inclined with respect to the longitudinal axis of the first tubular member, wherein the first and second cam surfaces are oppositely inclined with respect to the longitudinal axis and wherein at least one of the second or first tubular members is movable along the longitudinal axis relative to the other of the tubular members to move the tubular members together; cam follower mounted on and between the first and second cam surfaces, wherein the cam follower moves on both cam surfaces simultaneously as the tubular members are moved together; and force storage mechanism with opposed ends which is mounted along and around the longitudinal axis of the tubular members so as to bias the tubular members apart.

DESCRIPTION OF THE PREFERRED EMBODIMENTS

Figure 1:
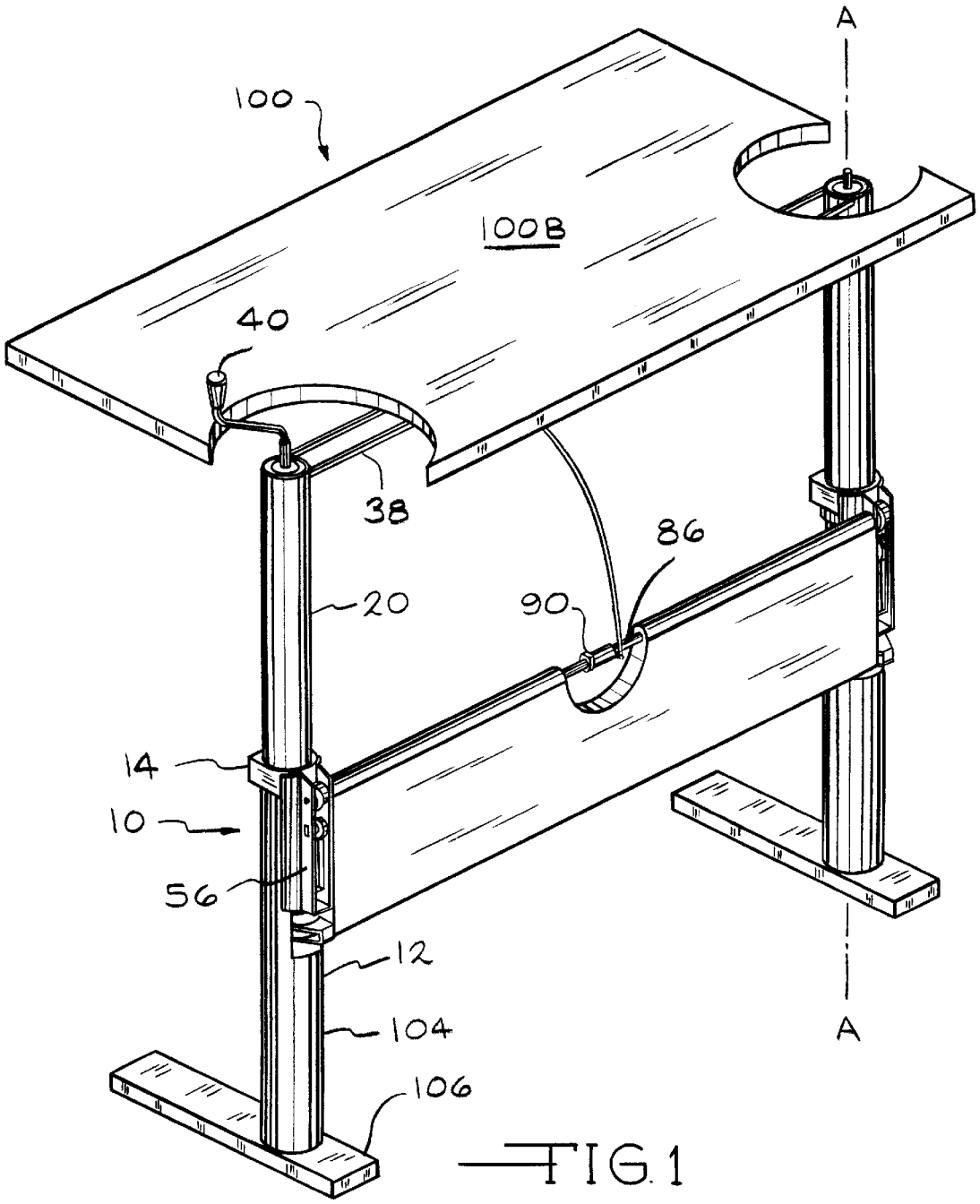
FIG. 1 is a perspective view of the work station 100 showing the apparatuses 10 in the legs 104 of the work station 100.

FIG. 1 shows the improved counterbalance or counterweight apparatus 10 of the present invention mounted in the legs 104 of a work station 100 for raising or lowering the work surface 100B of the work station 100 or the top of a table (not shown). The work surface 100B or the top of the table can be provided with a load (not shown) such as a computer or typewriter, etc. The apparatus 10 includes an outer tubular member 12, an inner tubular member 20, a dampener 30, a force storage mechanism such as a spring or springs 69, 70 and 71, a cam follower 50 and an anti-racking mechanism 56. The outer tubular member 12 preferably has a hollow, cylindrical shape with opposed ends 12A and 12B and a sidewall 12C therebetween forming an inner cavity 12D. The top end 12A of the outer tubular member 12 is open. The bottom end 12B of the member 12 can be opened or closed and is preferably mounted on a foot 106 for the leg 104 of the work station 100. The outer tubular member 12 may be mounted to the foot 106 of the leg 104 by any suitable means.

An outer cam insert 16 is mounted on the inner surface of the sidewall 12C of the outer tubular member 12 in the inner cavity 12D of the outer tubular member 12. The outer cam insert 16 is preferably mounted adjacent the bottom end 12B of the outer tubular member 12. The outer cam insert 16 has a pair of cam edges or surfaces 16B and a pair of guide edges or surfaces 16C. The guide edges 16C of the insert 16 are preferably straight and parallel to the longitudinal axis A—A of the counterbalance apparatus 10. The cam edges 16B have a first curved portion and a second straight portion. The first curved portion extends from the top end of the insert 16 to the top end of the second straight portion. The first curved portion of the cam edges 16B have a linear slope. The second straight portion extends from the first curved portion to the bottom end of the insert 16. The second straight portion is vertical and parallel to the longitudinal axis A—A of the apparatus. The outer cam insert 16 is preferably constructed of a pair of identical outer cam inserts. The inserts form a cylindrical shape when mounted on the inner surface of the sidewall of the outer tubular member 12, such as to follow the curvature of the sidewall 12C of the outer tubular member 12. The pair of inserts are spaced apart evenly around the sidewall of the outer tubular member 12 such that the guide edge of one insert is spaced 180° apart from the guide edge of the other insert. The insert 16 is mounted on the sidewall 12C such as to extend completely around the sidewall 12C. The outer diameter of the insert 16 is preferably slightly less than the inner diameter of the outer tubular member 12 such that the insert 16 can be inserted into the inner cavity 12D of the member 12 without extensive effort. However, the relationship of the outer diameter of the insert 16 to the inner diameter of the outer tubular member 12 is such that when the insert 16 is fastened to the sidewall 12C of the member 12, the outer surface of the insert 16 is adjacent to and in contact with the inner surface of the sidewall 12C of the outer tubular member 12. The inner diameter of the insert 16 is greater than the outer diameter of the inner tubular member 20 such that the inner tubular member 20 can easily slide into the insert 16 and the outer tubular member 12.

Figure 5:
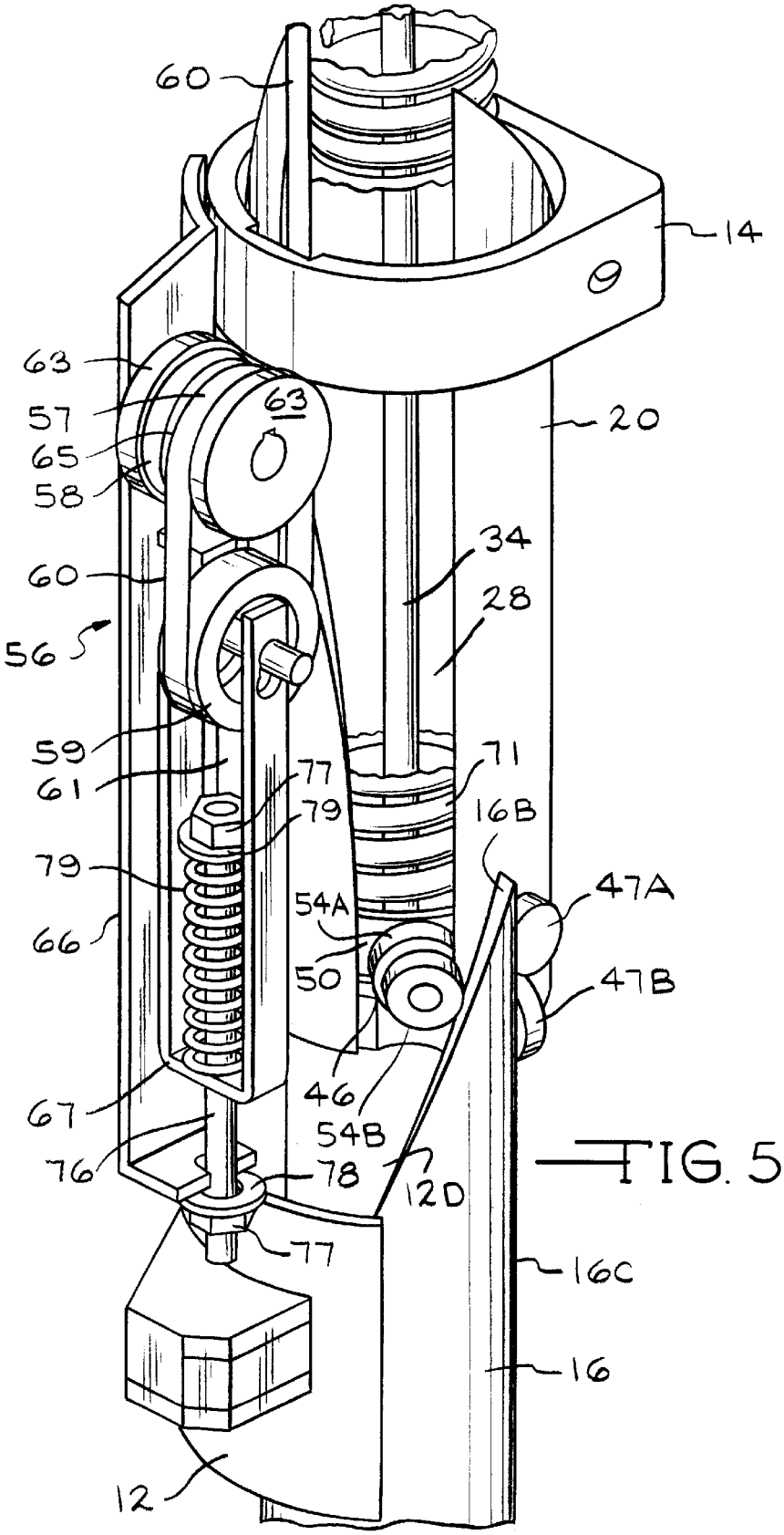
FIG. 5 is a partial view of the inner tubular member 20 in the outer tubular member 12 showing the anti-racking mechanism 56.
Figure 6:
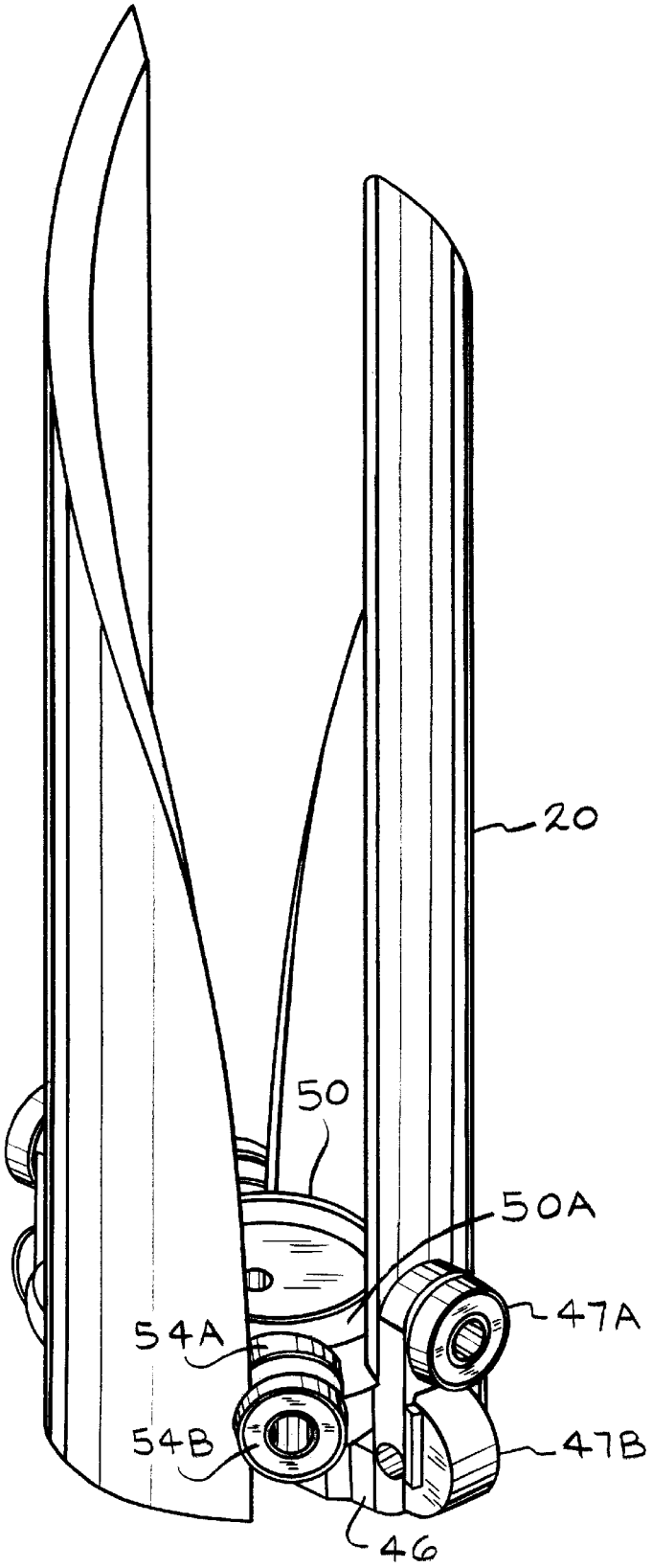
FIG. 6 is a view of the inner cam insert 26 showing the cam follower 50 and cam rollers 54 and the inner roller mechanism 46 with rollers 47.

The open top end 12A of the outer tubular member 12 is provided with a guide 14 (FIG. 5). The guide 14 includes a pair of inner rollers 15 which assist the movement of the inner tubular member 20 into and out of the outer tubular member 12. The top end 12A of the outer tubular member 12 also has a notch (not shown) which allows the first metal strap 60 of the anti-racking mechanism 56 to be moved inside of the outer tubular member 12 to be secured on the top end 20A of the inner tubular member 20.

The inner tubular member 20 preferably has a hollow, cylindrical shape with spaced apart, opposed ends 20A and 20B with a sidewall 20C extending therebetween. The inner tubular member 20 is telescopically mounted in the open top end 12A of the outer tubular member 12 such that the bottom end 20B of the inner member 20 extends into the top end 12A of the outer tubular member 12. The top end 20A of the member 20 is preferably closed. A top mounting bracket is preferably provided on the top end 20A of the inner tubular member 20. The top mounting bracket is mounted on the underneath side of the work surface 100B and securely holds the apparatus 10 in contact with the work surface 100B. The closed top end 20A of the inner member 20 and the top mounting bracket have an opening to allow the adjustment head 36A of the threaded rod 36 to extend up through the work surface 100B (to be described in detail hereinafter). The sidewall 20C of the inner tubular member 20 has angled openings 28 adjacent the bottom end 20B extending lengthwise between the ends 20A and 20B of the tubular member 20. The openings 28 are preferably closed at each end such that the rollers 54 of the cam follower 50 do not extend beyond the ends of the openings 28. There are preferably two (2) identical angled openings 28.

An inner cam insert 26 is mounted on the inner surface of the sidewall 20C of the inner tubular member 20 adjacent the bottom end 20B of the member 20. The cam edges 26B are curved and preferably have a non-linear slope. The cam edges of the inner cam insert 26 preferably have a shape such that the slopes of the curve of the cam edges which form the cam surfaces 26B are non-linear and identical. The cam edges 26B preferably extend the entire length of the insert 26. The secondary edges 26C can be of any shape; however, in the preferred embodiment, the secondary edges 26C are vertical and parallel to the longitudinal axis A—A of the apparatus 10. The insert 26 is mounted on the sidewall 20C such as to extend completely around the sidewall 20C of the inner tubular member 20. The inner cam insert 26 has a pair of cam edges or surfaces 26B and a pair of secondary edges 26C. The inner cam insert 26 is preferably constructed of a pair of identical inner cam inserts. The inserts 16 form a cylindrical shape when on the inner surface of the sidewall of the inner tubular member, such as to follow the curvature of the sidewall 20C of the inner tubular member 20. The inserts are spaced apart evenly around the sidewall 20C of the inner tubular member 20 such that the cam edge 26B of one insert is spaced 180° apart from the cam edge 26B of the other insert. The inner cam insert 26 is preferably mounted adjacent the bottom 20B of the inner tubular member 20 such that the cam edges 26B of the insert are adjacent one of the openings of the pair of openings 28. In the preferred embodiment, one opening is located adjacent each cam edge 26B. The outer diameter of the inner cam insert 26 is preferably slightly less than the inner diameter of the inner tubular member 20 such that the inner cam insert 26 can be inserted onto the inner tubular member 20 without extensive effort. However, the relationship of the outer diameter of the inner cam insert 26 to the inner diameter of the inner tubular member 20 is such that when the insert 26 is fastened to the sidewall 20C of the member 20, the outer surface of the inner cam insert 26 is adjacent and in contact with the inner surface of the sidewall 20C of the inner tubular member 20. When the inner tubular member 20 is correctly positioned inside the outer tubular member 12, the outer and inner cam inserts 16 and 26 are preferably positioned such that the cam edges 16B and 26B of the outer and inner cam inserts 16 and 26 alternate around the circumference of the tubular members 12 and 20. The inserts 16 and 26 are preferably mounted to the sidewall 12C and 20C of the outer and inner tubular members 12 and 20, respectively by rivets or screws. However, any well known means of securely fastening the inserts 16 and 26 to the tubular members 12 and 20 can be used. The inserts 16 and 26 are preferably constructed of formed steel. However any durable low friction material can be used. In the preferred embodiment, the inserts 16 and 26 have a thickness equal to the width of the rollers 54 of the cam follower 50 such that the rollers 54 move along the cam surfaces 16B and 26B of the inserts 16 and 26 and do not contact the sidewalls 12C or 20C of the tubular members 12 or 20 or the adjacent inserts 16 or 26.

An inner roller mechanism 46 is preferably mounted on the bottom end 20B of the inner tubular member 20. The inner roller mechanism 46 includes two (2) pairs of rollers 47. The pairs of rollers 47 are spaced 180° apart around the circumference of the inner tubular member 20. The pairs of rollers 47 are secured together by a brace 46A which extends across the bottom of the inner tubular member 20. The brace 46A has a center opening 46B to accommodate the end of the piston rod 34. The pairs of rollers 47 are spaced such as to not interfere with the openings 28 in the inner tubular member 20 or the cam edges 26B of the inner cam insert 26. Each pair of rollers 47 includes two (2) rollers, a torque compensation roller 47A and an anti-cantilever roller 47B. In each pair of rollers 47, the torque compensation roller 47A is spaced above the anti-cantilever roller 47B and is orientated to contact and move along the guide edges 16C of the outer cam insert 16 for the outer tubular member 12. The anti-cantilever roller 47B is orientated such as to contact and move along the sidewall 12C of the outer tubular member 12 adjacent the guide edges 16C. The inner roller mechanism 46 assists the inner tubular member 20 in moving smoothly into and out of the outer tubular member 12 by compensating for the torque which tends to rotate the inner tubular member 20 and by preventing cantilevering of the inner tubular member 20 inside the outer tubular member 12. The movement of cam rollers 54 along the linear cam surfaces 16B of the outer cam insert 16, causes a torque which tends to rotate the inner tubular member 20. However, as the cam rollers 54 move along the cam surfaces 16B, the torque compensation rollers 47A move along the guide edges or surfaces 16C adjacent to the cam surfaces 16B. Since the torque compensation rollers 47A are fixed on the inner tubular member 20, as the inner tubular member 20 moves downward into the outer tubular member 20, the cam follower 50 is forced to rotate. The cam rollers 54 are forced to move along the cam surface 16B, while the inner tubular member 20 does not rotate. One of the pair of the outer inserts moves between each of the cam rollers 54 and the torque compensation rollers 47A similar to a wedge. The anti-cantilever rollers 47B move along the inner surface of the sidewall 12C of the outer tubular member 12. In the preferred embodiment, the anti-cantilever rollers 47B do not make contact or make only minimal contact with the sidewall 12C of the outer tubular member 20. However, if a force is exerted on the front or back edge of the work surface 100B causing a tilt in the work surface 100B with respect to the feet 106 of the work station 100 and causing the inner tubular member 20 to tilt in the outer tubular member 12, the anti-cantilever rollers 47B will contact the sidewall 12C of the outer tubular member 12 preventing excess tilting or cantilevering of the inner tubular member 20 in the outer tubular member 12. The anti-cantilever rollers 47B also prevent the bottom end 20B of the inner tubular member 20 from contacting the sidewall 20C of the outer tubular member 12 while allowing the inner tubular member 20 to continue to be able to move up and down in the outer tubular member 12.

A dampener 30 is preferably mounted within the inner tubular member 20. The dampener 30 includes a tubular body 32 and a piston rod 34 and has a piston cylinder design. A threaded rod 36 is mounted on the top end 32 A of the body 32 of the dampener 30. The end of the threaded rod 36 opposite the dampener 30 has an adjustment head 36A for setting the adjusted preload force on the springs 69, 70 and 71. The dampener 30 is mounted in the inner tubular member 20 such that the top end of the threaded rod 36 is adjacent the top end 20A of the inner tubular member 20. The dampener 30 is preferably mounted in the inner tubular member 20 such that the adjustment head 36A of the threaded rod 36 extends through the opening in the top end 20A of the inner tubular member 20 and through the top mounting bracket and through an opening in the work surface 100B. Preferably, when the dampener 30 and threaded rod 36 are correctly positioned in the tubular member 20 and the apparatus 10 is correctly mounted on the work station 100, the adjustment head 36A is slightly below the top surface of the work surface 100B. Preferably, the opening in the work surface 100B is slightly larger than the adjustment head 36A such as to allow a handle 40 to be mounted over the adjustment head 36A to allow rotation of the adjustment head 36A and thus, rotation of the dampener 30.

Figure 2A:
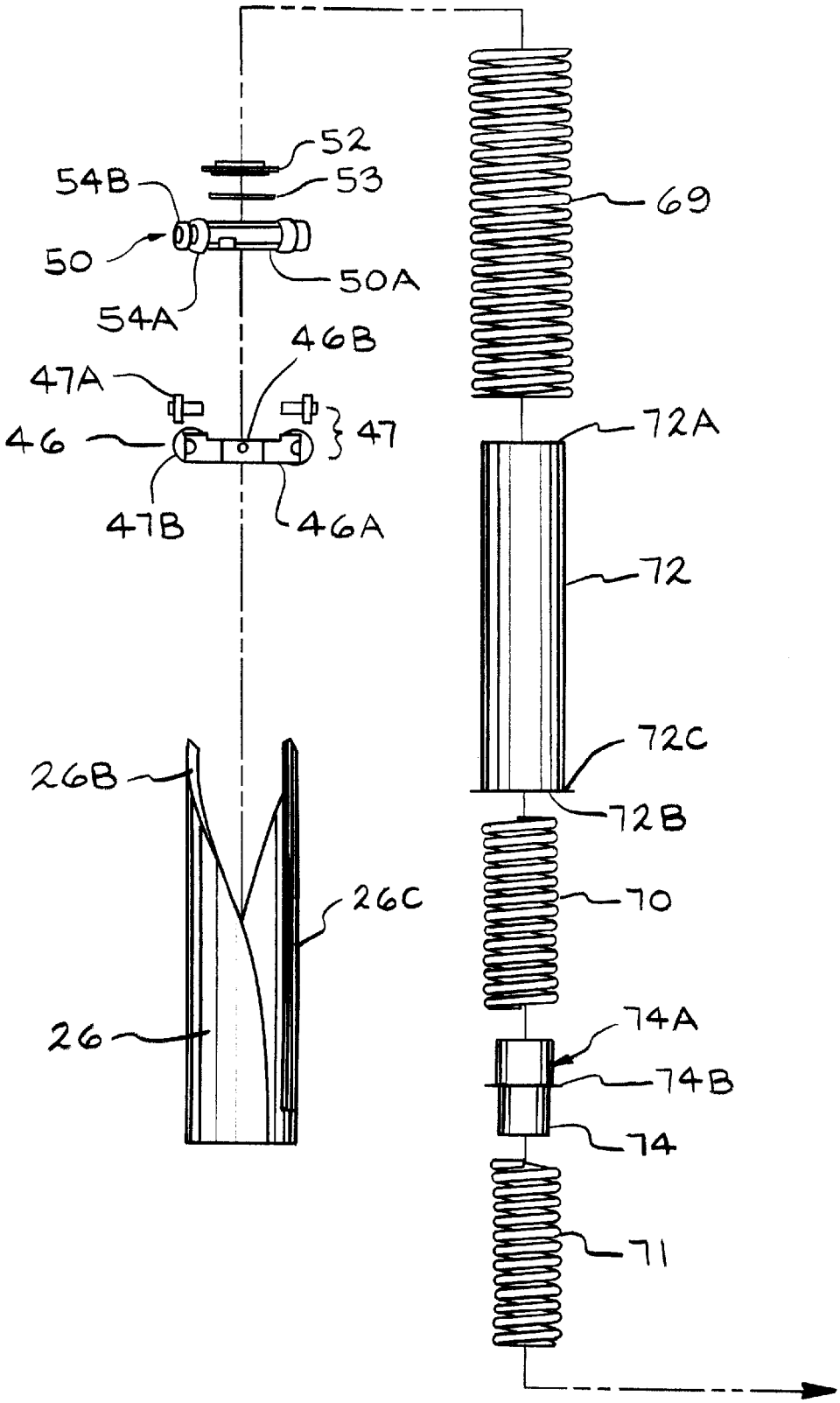
FIGS. 2A to 2C are an exploded view of the counterbalance apparatus 10.
Figure 2B:
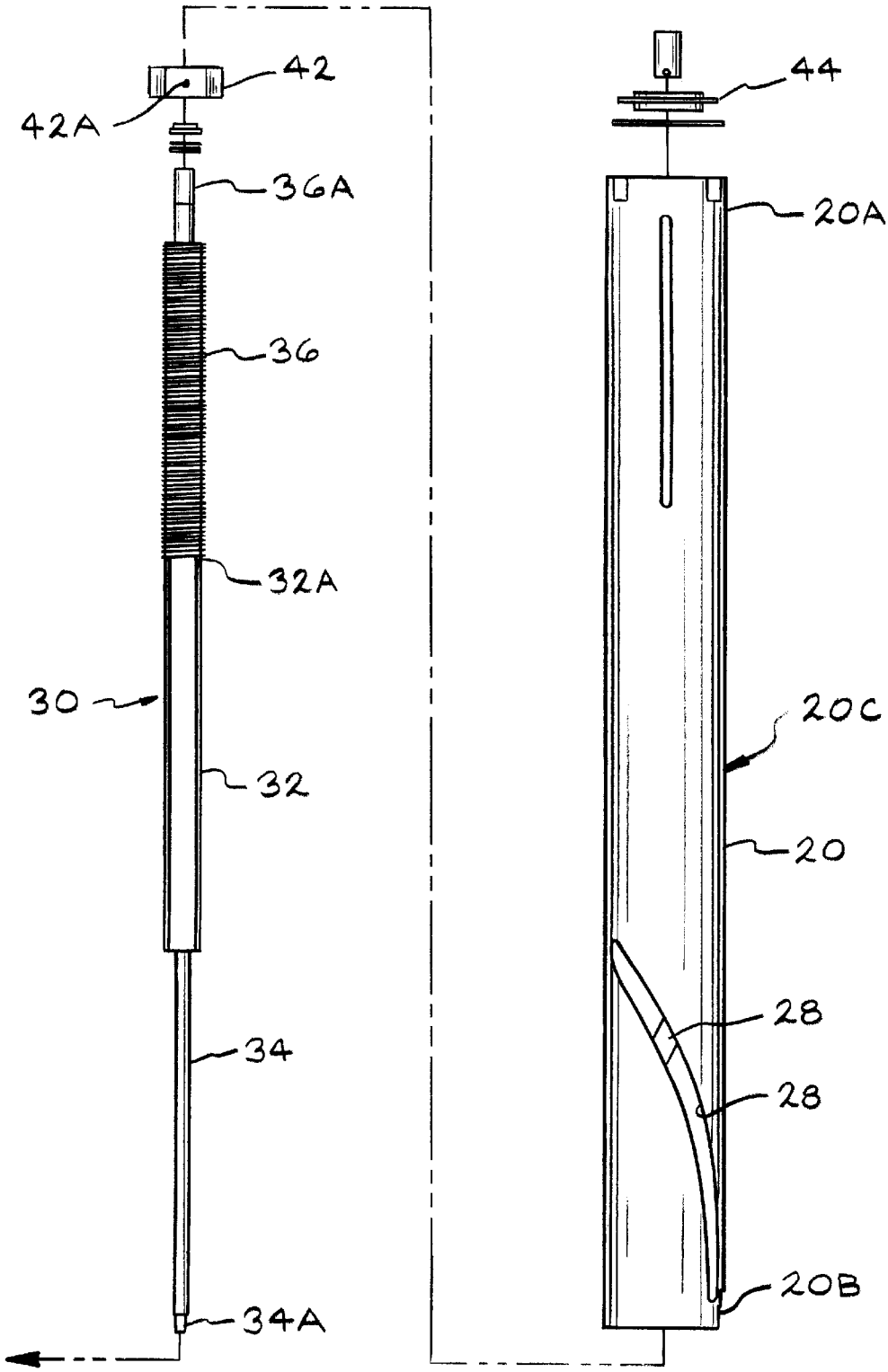
Figure 2C:
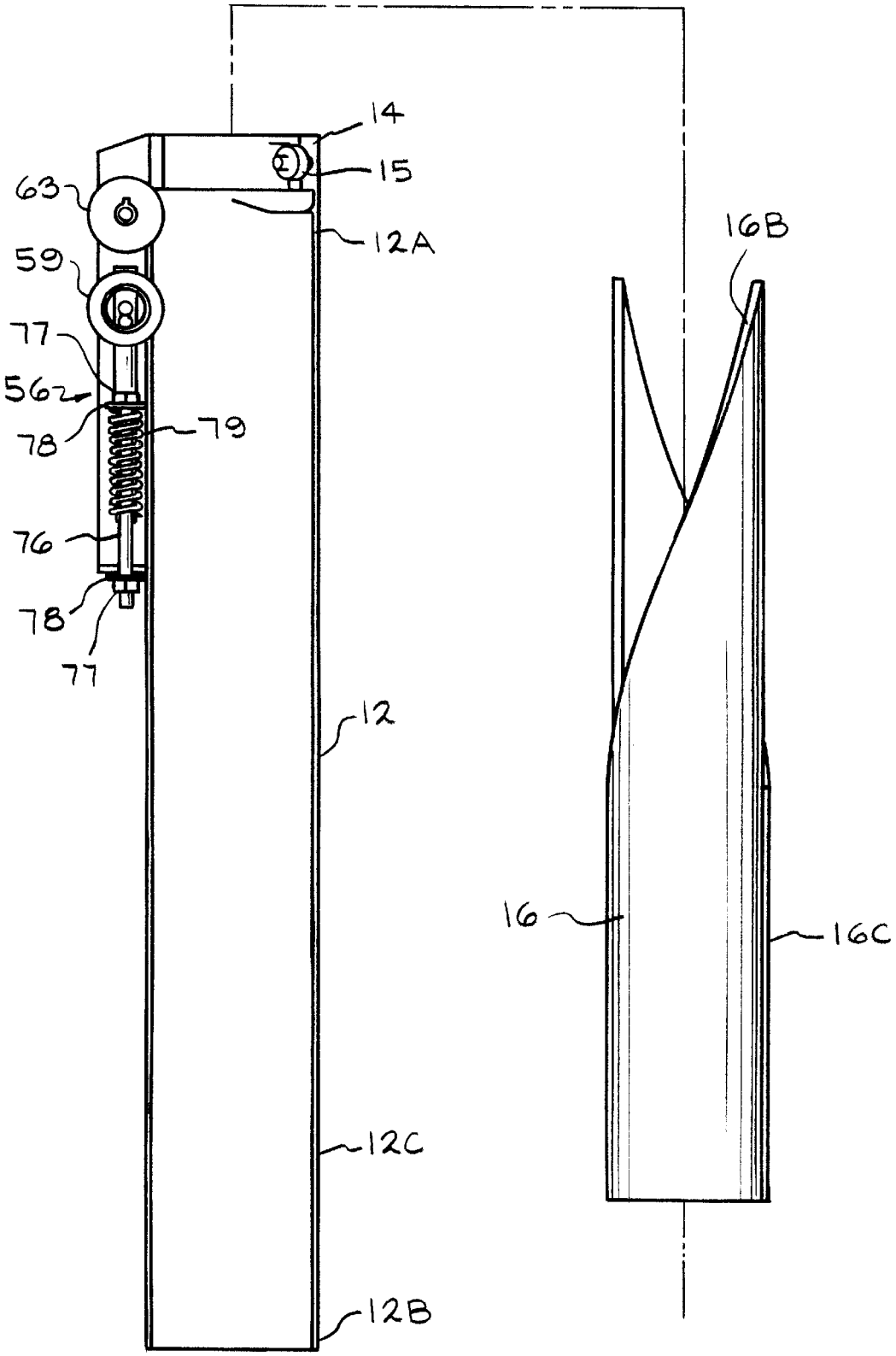
Figure 3:
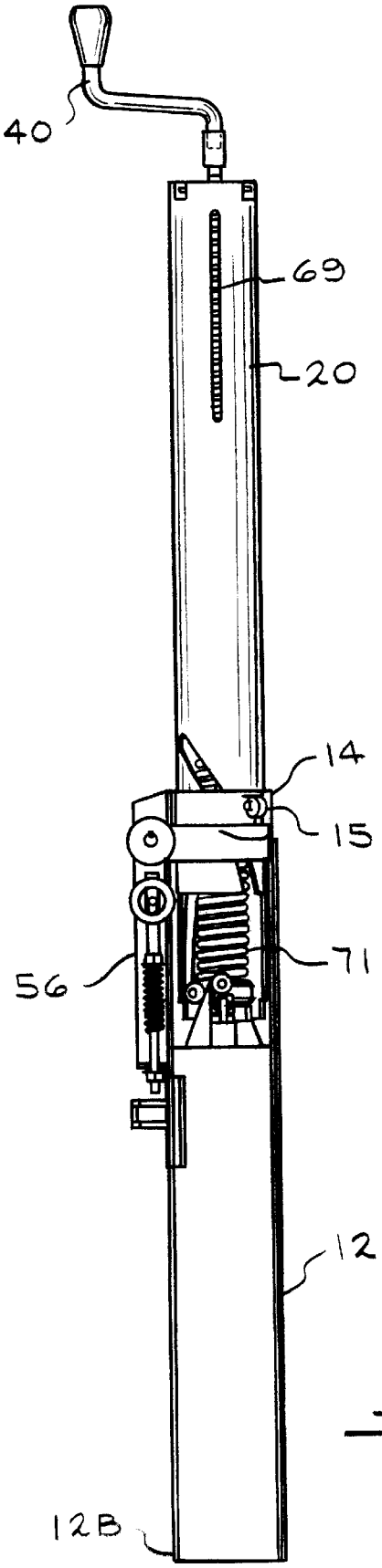
FIG. 3 is a front view of the counterbalance apparatus 10 in the fully extended position with the outer tubular member 12 in cross-section.
Figure 4:
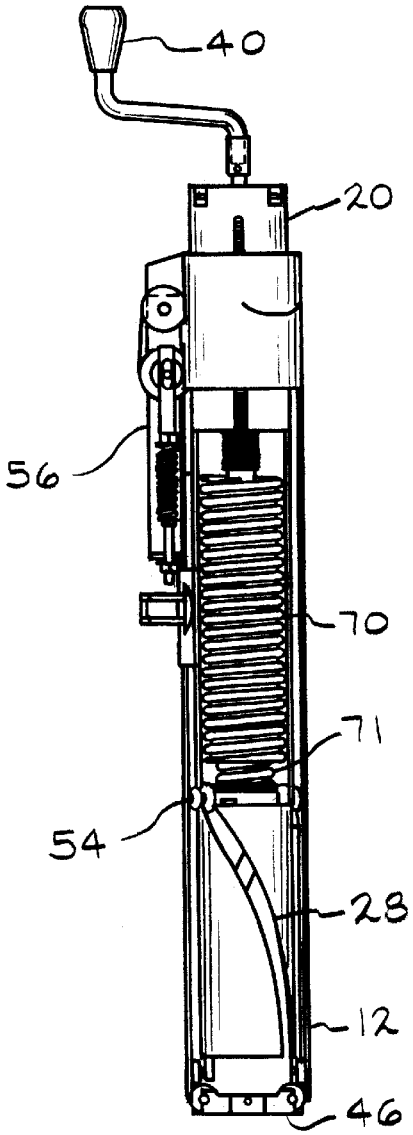
FIG. 4 is a front view of the counterbalance apparatus 10 in the fully compressed position with the outer tubular member 12 in cross-section.

An adjustment nut 42 is threadably mated on the threaded, outer surface of the threaded rod 36 and is able to move, through rotation, along the longitudinal axis A—A of the apparatus 10 (FIG. 2B). A locking pin 42 A is threadably mated into an opening in the perimeter of the adjustment nut. The pin (not shown) extends outward through the locking slot in the sidewall 20C of the inner tubular member 20. The pin is preferably of a size such as to easily move up and down the slot while preventing the adjustment nut from rotating as the dampener 30 and threaded rod 36 are rotated by the adjustment head 36A. The adjustment head 36A allows the distance between the adjustment nut and the stopper 52 which is adjacent the bottom end 34A of the piston rod 34 and the cam follower 50 to be varied to vary the adjusted preload force on the springs 69, 70 or 71 (to be described in detail hereinafter). The greater the load on the work surface 100B, the greater the compression of the springs 69, 70 or 71. As the threaded rod 36 is rotated, the adjustment nut moves up or down the threaded rod 36 along the longitudinal axis A—A of the apparatus 10 depending upon the direction of rotation of the threaded rod 36. When two (2) apparatuses 10 are used, one in each leg 104 of the work surface 100B, the top end of the threaded rod 36 below the top surface of the work surface 100B and above the adjustment nut is provided with an adjustment sprocket 44. The sprocket 44 is attached by a chain or belt 38 to an identical sprocket 44 located on the adjustment rod 36 of the apparatus 10 in the opposite leg 104. The connection of the adjustment rods 36 of the apparatuses 10 ensures that the preload force on the springs 69, 70 and 71 in each apparatus 10 is the same.

The cam follower or spider 50 is preferably mounted onto the bottom end 34A of the piston rod 34 opposite the body 32 of the dampener 30. The cam follower 50 preferably includes a circular center portion 50A having a pair of pins on which are rotatably mounted a pair of cam rollers 54. The cam rollers 54 are preferably spaced apart 180° around the circumference of the center portion. Each pair of cam rollers 54 includes an inner and outer cam roller 54A and 54B. Each pair of cam rollers 54 is preferably identical. The rollers 54 are preferably roller bearings having the shape of wheels with ball bearings therebetween. The cam rollers 54 could also be bronze bushings or plastic bushings. The rollers 54 are mounted such that the axis of the wheel is perpendicular to the longitudinal axis A—A of the apparatus 10.

Preferably, the thickness of the rollers 54 is the same as the thickness of the outer and inner cam inserts 16 and 26 such that the cam rollers 54 ride along the cam edges or cam surfaces 16B and 26B. Preferably, the rollers 54 are spaced slightly apart such as to accommodate the thickness of the sidewall 20C of the inner tubular member 20 spaced between the inserts 16 and 26. The openings 28 in the inner tubular member 20 allow the cam rollers 54 to move along both the inner and outer cam inserts 16 and 26. The cam follower 50 is mounted in the apparatus 10 such that the center portion 50A is spaced within the inner tubular member 20 and the pins extend outward from the center portion 50A through the angled openings 28 in the inner tubular member 20. The rollers 54 are mounted on the pins such that the inner rollers 54A are adjacent the inner tubular member 20 and move along the cam surfaces 26B of the inner cam insert 26 and the outer cam rollers 54B are adjacent the outer tubular member 12 and move along the outer cam surfaces 16B of the outer cam insert 16. The piston rod 34 is preferably able to rotate in the body 32 of the dampener 30 such that the cam follower 50 is able to rotate as it moves along the longitudinal axis A—A of the apparatus 10. Alternatively, the piston rod 34 is fixed and unable to rotate and the cam follower 50 is rotatably mounted on the bottom end 34A of the piston rod 34. The diameter of the center portion 50A of the cam follower 50 is slightly smaller than the inner diameter of the inner cam insert 26 such that the cam follower 50 is able to freely rotate within the inner tubular member 20 and the inner cam insert 26.

In the preferred embodiment, the force storage mechanism for the apparatus 10 is comprised of three (3) springs 69, 70 and 71. The top spring 69 is preferably greater in length and has a greater inner diameter than the middle and bottom springs 70 and 71. The top spring 69 is preferably located around the threaded rod 36 at the top of the dampener 30. A cylindrical insert 72 having a closed top end 72A and an open bottom end 72B is mounted in the inner cavity of the top spring 69 extending upward from the bottom of the top spring 69. The cylindrical insert 72 has a bottom flange 72A at the open bottom end which has a diameter greater than the outer diameter of the top spring 69 such that the bottom of the top spring 69 rests on the bottom flange 72C of the insert 72. The cylindrical insert 72 has an outer diameter only slightly less than the inner diameter of the top spring 69. The top of the top spring 69 rests against the adjustment nut 77. The middle spring 70 is mounted inside the cylindrical insert 72 and extends upward until the top of the middle spring 70 contacts the closed top end 72A of the cylindrical insert 72. The length of the middle spring 70 is such as to extend beyond the open bottom end 72B of the cylindrical insert 72. A spring connector 74 is mounted in the bottom end of the middle spring 70. The spring connector 74 acts to connect the middle and bottom springs 70 and 71 together such that the springs 70 and 71 act together. The spring connector 74 is comprised of a cylinder 74A having a washer 74B permanently fixed about the center of the cylinder 74A. The top portion of the cylinder 74A above the washer 74B has an outer diameter less than the inner diameter of the middle spring 70 and the bottom portion of the cylinder 74A. Below the washer, has an outer diameter less than the inner diameter of the bottom spring 71. The washer 74B has a circumference (outer diameter) greater than the outer diameter of the middle or bottom spring 70 or 71. Preferably, the middle spring 70 has an inner diameter greater than the inner diameter of the bottom spring 71. The middle spring 70 extends from the closed top end 72A of the cylindrical insert 72 to the washer 74B of the spring connector 74. The bottom spring 71 extends from the washer 74B of the spring connector 74 to the center portion 50A of the cam follower 50.

A stopper 52 and spacer 53 are preferably positioned adjacent the center portion 50A of the cam follower 50 on the side adjacent the dampener 30. The spacer 53 is positioned between the stopper 52 and the cam follower 50. The end of the bottom spring 71 extends into the stopper 52 which allows for securely positioning the bottom spring 71 around the dampener 30. The stopper 52 and spacer 53 prevent the end of the bottom spring 71 from making contact with the cam follower 50. The spacer 53 has rollers which contact the cam follower 50 and allow the cam follower 50 to freely rotate without interfering with the bottom spring 71. Preferably, the bottom spring 71 does not rotate.

The three (3) springs 69, 70 and 71 are preferably mounted around the outside of the dampener 30 and the threaded rod 36 between the stopper 52 and the adjustment nut. The springs 69, 70 and 71 are preferably non-linear such that the springs 69, 70 and 71 do not compress evenly along their length and the composite force of the springs 69, 70 and 71 is non linear. The springs 69, 70 and 71 could be any type. The springs 69, 70 and 71 are preferably coil springs having unevenly spaced coils which account for the non-linear compression of the springs 69, 70 and 71. In another embodiment (not shown), a single spring is used. The spring is mounted around the dampener 30 such that the coils of the spring are spaced farther and farther apart as the spring extends toward the adjustment nut. Alternatively, the single spring could have an hourglass shape such that the diameter of the coils adjacent the center of the spring is smaller. The hourglass shape also allows for non-linear compression of the spring. In addition, any form of force storage mechanism could be used instead of a coil spring such as for instance, a pneumatic spring. In addition, the springs 69, 70 and 71 could be torsional springs (not shown) having a resilient center portion fixably mounted in an outer shell which non-linearly varies the torque acting on the work surface 100B as a result of rotation of a shaft fixably mounted in the center portion which causes the inside of the center portion to exert a torque on the shaft.

An anti-racking mechanism 56 is mounted on the outside of the sidewall 12C of the outer tubular member 12 adjacent the top end 12A. The anti-racking mechanism 56 includes a pair of upper spools 57 and 58, a lower idler spool 59 and first and second steel straps 60 and 61. The upper spools 57 and 58 are rotatably mounted between a pair of outer spools 63. The pair of outer spools 63 are spaced apart by a spacer 65. The outer spools 63 are rotatably mounted to a bracket 66 mounted on the outside surface of the sidewall 12C of the outer tubular member 12. The upper spools 57 and 58 are mounted coaxially and share a common shaft. In the preferred embodiment, an alignment shaft 86 extends outward from the anti-racking mechanism 56 of one leg 104 of the work station to the anti-racking mechanism 56 of the second leg 104 (FIG. 1). The lower idler spool 59 is mounted below the first upper spool 57. A first steel band or strap 60 is mounted to and extends around the first upper spool 57. The first strap 60 extends downward from the upper spool 57 on the side opposite the outer tubular member 12 to the lower idler spool 59. The first strap 60 extends around the lower spool 59 in a counterclockwise direction and extends upward and is connected to the top end 20A of the inner tubular member 20. The first steel strap 60 extends through an opening in the outer tubular member 12 and through a notch in the guide 14 and extends between the inner sidewall of the outer tubular member 12 and the outer sidewall of the inner tubular member 20. A second steel band or strap 61 is mounted on and extends around the second upper spool 58. The steel strap 61 extends downward from the upper spool 58 adjacent the outer tubular member 12. The second steel strap 61 extends through an opening in the outer tubular member 12 and extends downward towards and is connected to the bottom end 20B of the inner tubular member 20. As the inner tubular member 20 is moved into and out of the outer tubular member 12, the steel straps 60 and 61 cause the upper spools 57 and 58 to rotate. Rotation of the spools 57 and 58 acts to wrap one (1) steel strap while unraveling (unwrapping) the other steel strap. As the upper spools rotate, the alignment shaft 86 also rotates.

In the preferred embodiment, a pair of apparatuses 10 are used in each leg 104 of the work station 100. When either apparatus 10 is used such that the inner tubular member 20 moves in and out of the outer tubular member 12, the spools 57 and 58 rotate which rotates the alignment shaft 86 and consequently, the other spools 57 and 58 at the other end. The rotating shaft 86 extending between the apparatuses 10 ensures that the apparatuses 10 act in unison during raising and lowering the work surface 100B. The alignment shaft 86 also distributes the load on the work surface 100B between the two counterbalance apparatuses 10. Therefore, if the load on the work surface 100B is not distributed evenly on the work surface 100B, the shaft 86 ensures that the apparatuses 10 operate as a single unit to lift and lower the load. Therefore, the shaft 86 compensates for offset loads. In the alternate embodiment, with only one apparatus 10 but having two legs 104, the rotating alignment shaft 86 ensures that the legs 104 of the work station 100 raise and lower in unison.

The idler spool 59 is rotatably mounted on a shaft which is mounted to the top of a U-shaped bracket 67. The bottom of the U-shaped bracket 67 has a hole through which is mounted a rod 76 having a nut 77 and washer 78 at each end. A spring 79 is mounted around the rod 76 between the upper nut (not shown) and washer 78 and the bottom of the U-shaped bracket 67. The spring 79 allows for preloading of the first strap 60. In the preferred embodiment, the preloading force is equal to 150 lbs. The rod extends downward from the U-shaped bracket 67 and extends through a notch in the anti-racking bracket 66. A separate bracket could also be used. The rod 76 and U-shaped bracket 67 allow for adjusting the distance between the upper spool 57 and the lower idler spool 59 which changes the tension of both straps 60 and 61. The lower idler spool 59 with the spring 79, rod 76 and upper and lower nuts and washer 77 and 78 accounts and compensates for the change in spool diameter as the first strap 60 wraps and unwraps on top of itself as the inner tubular member 20 moves up and down. The lower idler spool 59 with the spring 79 takes up the slack in the strap 60 as the strap 60 unwraps from around the upper spool 57. Preferably, the distance can be adjusted a total of 0.25 inches.

In the preferred embodiment, a spring wrap brake 90 is mounted around the center of the alignment shaft 86 (FIG. 1). The spring wrap brake 90 is preferably activated by the user to allow the apparatuses or apparatus 10 to be used to raise and lower the work surface 100B. The spring wrap brake 90 is preferably similar to those well known in the art. A hand activated release lever (not shown) is preferably mounted on the underneath surface of the work surface 100B and allows the user to disengage the brake 90 to allow for raising and lowering of the work surface 100B. To release the brake 90, the lever is pulled which opens up the spring coils of the spring wrap brake 90 around the alignment shaft 86 which allows the alignment shaft 86 to rotate. In the preferred embodiment, the brake 90 allows the work surface 100B to be raised but does not allow lowering of the work surface 100B without deactivation of the brake 90.

An electric motor (not shown) can be connected to the alignment shaft 86 to allow automated raising and lowering of the work surface 100B. Use of an electric motor allows a user to raise and lower the work surface 100B without exerting any force. The electric motor can be connected to the alignment shaft 86 by a belt and pulley system (not shown), a series of gears or any other well known mechanical linkage method. Due to the use of the counterbalance apparatus 10, the horsepower of the electric motor used to raise and lower the work surface 100B can be relatively small such as 0.01 horsepower.

Optionally, a brake is located on the outer tubular member 12 of the apparatus 10 to lock the apparatus 10 at a certain vertical position. The brake preferably includes a pin having a handle at one end. The pin is extended through the outer tubular member 12 and into holes (not shown) in the inner tubular member 20. The exact vertical position of the work surface 100B is determined by the position of the holes in the inner tubular member 20. Alternatively, the brake operates by friction and the pin is threaded through the outer tubular member 12 and into contact with the inner tubular member 20 thus, preventing the outer tubular member 12 and inner tubular member 20 from moving with respect to each other. In an alternate embodiment where the apparatus 10 is mounted between the legs, the legs are preferably provided with a brake (not shown).

In Use

The top end 20A of the inner tubular member 20 is mounted to the underside of the work surface 100B such that the adjustment head 36A extends upward through the opening in the work surface 100B. The adjustment handle 40 is attached onto the adjustment head 36A and is rotated until the initial tension or adjusted preload force on the springs 69, 70 and 71 is correct for the weight of the work surface 100B and any items on the work station 100 (FIG. 1). Once the apparatus 10 is properly installed and the adjusted preload force is correctly set, the forces exerted on the work surface 110B are in equilibrium which allows the work surface 100B to be easily moved up or down in a vertical direction.

To move the work surface 100B, the user exerts a small force on the work surface 100B in the direction the work surface 100B is to be moved. During vertical movement of the work surface 100B, the inner tubular member 20 telescopes in and out of the outer tubular member 12. In the fully compressed position, with the work surface 100B in the lowermost position, the inner tubular member 20 is almost fully within the outer tubular member 12 and the springs 69, 70 and 71 and dampener 30 are in the compressed position. To raise the work surface 100B, the user exerts an upward force on the work surface 100B. As the work station 100 is moved vertically upward, the inner tubular member 20 is lifted upward, out of the outer tubular member 12. The force of the springs 69, 70 and 71 pushing upward assists the lifting force of the user to allow the user to lift a work surface 100B having a greater weight by exerting a relatively small force. In addition, the downward force of the inner cam surfaces 26B on the inner cam rollers 54A works against the upward force of the springs 69, 70 and 71 such that the force exerted on the work surface 100B remains constant throughout the complete movement of the work surface 100B. The force on the inner cam rollers 54A and consequently, on the cam surfaces 26B, changes as the compression of the springs 69, 70 and 71 is changed. The greater the compression of the springs 69, 70 and 71, the greater the load on the cam surfaces 26B. The inner cam rollers 54A travel along the cam surfaces 26B which allows the cam surfaces 26B to carry a greater part of the force of the springs 69, 70 and 71. The force on the outer cam rollers 54B and consequently, on the outer cam surfaces 16B, remains constant throughout the entire movement of the work surface 100B as a result of the adjusted preload force on the springs 69, 70 and 71 and is directly related to the adjusted preload force. The curve of the inner cam surfaces 26B is preferably non-linear and the springs 69, 70 and 71 are preferably non-constant. As the springs 69, 70 and 71 are expanded and the inner cam rollers 54A move along the inner cam surfaces 26B, the normal force exerted on the inner cam rollers 54A changes direction to compensate for the change in force exerted by the springs 69, 70 and 71. The angle of the curve of the inner cam surfaces 26B allows the force needed to move the work surface 100B up and down to remain constant regardless of the adjusted preload force on the apparatus 10. The inner cam rollers 54A of the cam follower 50 move along the cam surfaces 26B of the insert 26 in the inner tubular member 20 to compensate for the changing force of the springs 69, 70 and 71 to provide a constant force output. The inner cam surfaces 26B allow the force exerted on the work surface 100B to remain constant by varying the force normal to the inner cam rollers 54A to compensate for the varying force exerted by the springs 69, 70 and 71 resulting from the expansion of the springs 69, 70 and 71. The non-linear curve of the inner cam surfaces 26B creates a camming action between the inner cam rollers 54A and the inner cam surfaces 26B which varies the normal force exerted on the inner cam rollers 54A by the cam surfaces 26B. The inner cam surfaces 26B preferably carry the force of the springs 69, 70 and 71 beyond the initial preload force ($F_0$). The slope of the curve of the inner cam surfaces 26B is directly related to the slope of the curve of the non-constant springs 69, 70 and 71. The interaction of the springs 69, 70 and 71 and the inner cam rollers 54A allows for a constant force acting on the work surface 100B along the entire length of movement of the work surface 100B. Preferably, this is true regardless of the weight of the load on the work surface 100B. The relationship between the springs 69, 70 and 71 and the inner cam surfaces 26B allows the outer cam surfaces 16B to have a linear slope. Preferably, as the springs 69, 70 and 71 are expanded, the inner cam surfaces 26B take a decreasing share of the force of the springs 69, 70 and 71 while the outer cam surfaces 16B carry a constant share of the force. The angle of the curve of the outer cam surfaces 16B allows the work station 100 to move with a constant force. The outer cam rollers 54B of the cam follower 50 move along the outer cam surfaces 16B of the insert 16 on the outer tubular member 12 to counteract the constant adjusted preload force. In addition, the outer cam surfaces 16B provide the additional distance of movement of the work surface 100B not provided by the springs 69, 70 and 71. The interaction of the springs 69, 70 and 71 and the cam rollers 54 on the cam surfaces 26B or 16B also provide a constant torque throughout the entire movement of the work surface 100B.

As the inner tubular member 20 is moved upward, the pairs of cam rollers 54 on the cam follower 50 rotate within and follow along the cam surfaces 16B and 26B. In the initial compressed, or fully lowered position, the cam follower 50 is located at the lowermost point on the outer cam surfaces 16B and at the uppermost point on the inner cam surfaces 26B. As the inner tubular member 20 is lifted upward, the inner cam surfaces 26B begin to increasingly overlap the outer cam surfaces 16B. The outer cam rollers 54B follow the outer cam surfaces 16B upward toward the top of the outer cam surfaces 16B at the same time as the inner cam rollers 54A follow the inner cam surfaces 26B downward toward the bottom of the inner cam surfaces 26B. As the cam rollers 54 move along the surfaces 16B and 26B, the cam rollers 54 rotate about their axises perpendicular to the axis A—A of the apparatus 10 to allow for travel of the cam rollers 54 along the cam surfaces 16B and 26B. In addition, the cam follower 50 rotates around the longitudinal axis A—A of the apparatus 10. Rotation of the cam follower 50 is essential to allow the cam rollers 54A and 54B to follow the angled cam surfaces 16B and 26B of the inserts 16 and 26. In the final, fully expanded or fully raised position, the cam follower 50 is located at the uppermost point on the outer cam surfaces 16B and at the lowermost point on the inner cam surfaces 26B.

The operation of the apparatus 10 is the same but opposite for lowering the work surface 100B as for raising the work surface 100B. To lower the work surface 100B having the apparatus 10, the user exerts a force downward on the work surface 100B which compresses the springs 69, 70 and 71. As the springs 69, 70 and 71 compress, the springs 69, 70 and 71 exert an upward force on the work surface 100B. In response to the upward force of the springs 69, 70 and 71, the inner cam surfaces 26B exert an upward force on the inner cam rollers 54A and the outer cam surfaces 16B exert an upward force on the outer cam rollers 54B. The inner and outer cam rollers 54A and 54B travel on the inner and outer cam surfaces 26B and 16B such that the cam surfaces 26B and 16B are carrying the force of the springs 69, 70 and 71.

As the work surface 100B moves up or down and the springs 69, 70 and 71 expand or compress, the piston rod 34 of the dampener 30 is moved out of or into respectively, the body 32 of the dampener 30. The dampener 30 preferably exerts no upward or downward force on the apparatus 10 or the work surface 100B when the apparatus 10 is not moving. Preferably, during normal operation of the apparatus 10, the dampener 30 exerts only a negligible force when the apparatus 10 is moving. However, as the speed of movement increases, the force exerted by the dampener 30 in the direction opposite of the movement of the work surface 100B increases. The dampener 30 is used to prevent the work surface 100B from raising or lowering suddenly if a load is added or removed from the work surface 100B such that the adjusted preload force setting of the apparatus 10 is incorrect. The dampener 30 reduces the rate of ascent and descent of the work surface 100B, if the rate exceeds a preset limit. Once the work surface 100B has reached the desired height, the user applies the brake 90.

The springs 69, 70 and 71 are selected based upon the range of load on the work station 100 which is also used to determine the adjusted preload force applied to the apparatus 10. The adjusted preload force is the initial preload force ($F_0$) which is necessary to hold up the work surface 100B plus the force which is necessary to compensate for the load on the work surface 100B. The springs 69, 70 and 71 preferably are non-constant and change their force output at a constant, compound rate. Changing the range of adjusted preload force could require changing the springs 69, 70 and 71 and the curve of the inner cam surfaces 26B. The springs 69, 70 and 71 are preferably defined by the equation:

$$F=F_0\times e^{-KY}$$

where F is the force exerted by the springs 69, 70 and 71 and $F_0$ is the initial preload force on the springs 69, 70 and 71 which holds the work surface 100B up with no load on the table. The initial preload force ($F_0$) is preferably equal to the amount of force pushing down on the apparatus 10 by the work surface 100B. Preferably, in the initial position with the apparatus 10 fully extended, the springs 69, 70 and 71 are not fully extended. Preferably, the springs 69, 70 and 71 are compressed to provide the initial preload force ($F_0$). K is the constant defining the compound rate of change of the spring rate and Y is the displacement or the compression distance of the springs 69, 70 and 71 along the longitudinal axis A—A of the apparatus 10. The displacement of the springs 69, 70 and 71 is preferably calculated from a starting point of zero (0) which represents the length of the springs 69, 70 and 71 when the cam follower 50 is at the bottom of the inner cam surfaces 26B and the apparatus 10 is in the fully extended position. Y is preferably always a negative number. Preferably, there is a constant relationship between the force exerted by the springs (F) and the instantaneous spring constant IF/ΔY such that F/(IF/ΔY) remains constant throughout the compression of the springs 69, 70 and 71. In the alternate embodiment having a torsional spring, the inner cam grooves are selected to compensate for the non-constant torque of the spring so that the torque acting on the work surface 100B is constant throughout the travel of the work surface 100B. Once the springs 69, 70 and 71 are selected, the slope of the inner cam surfaces 26B is determined using the equation:

$$X = \frac{\left(Y - \frac{1}{K}[1 - e^{-KT}]\right)}{M}$$

where X is the displacement of the inner cam rollers 54A along the inner cam surfaces 26B and is an angular value due to the curvature of the cam surfaces 26B. M is the slope of the line representative of the outer cam surfaces 16B. In addition, the inner cam surfaces 26B can be adjusted to compensate for the addition of the friction force caused by the inner cam rollers 54A moving along the inner cam surfaces 26B. The outer cam surfaces 16B are linear and share the force of the springs 69, 70 and 71 with the inner cam surfaces 26B and compensate for the adjusted preload force or constant portion of the force applied to the apparatus 10. The outer cam surfaces 16B also allow the work surface 100B to travel an additional distance beyond the distance resulting from compression of the springs 69, 70 and 71. The angle of the inner cam surfaces 26B varies to compensate for the change in spring rate of the springs 69, 70 and 71. The axial length of the inner cam surfaces 26B represents the total compression of the springs 69, 70 and 71. The axial length of the inner cam surfaces 26B and the axial length of the outer cam surfaces 16B provide for the total amount of distance traveled by the work surface 100B.

The choice of springs 69, 70 and 71 and inner and outer cam surfaces 26B and 16B, allows for a constant force and a small constant torque acting on the work surface 100B by the apparatus 10 throughout the entire movement of the work surface 100B regardless of the specific adjusted preload force chosen within the range. Once the springs 69, 70 and 71 and inner and outer cam surfaces 26B and 16B are selected, the apparatus 10 is assembled and mounted onto the panel of the work station 100.

It is intended that the foregoing description be only illustrative of the present invention and that the present invention be limited only by the hereinafter appended claims.

I claim:

1. In a counterbalance apparatus, the improvement which comprises:

(a) a first tubular member defining a longitudinal axis and having a first end and a second end with at least one wall between the ends which forms the tubular member having an inner cavity, wherein a first cam surface is provided on the wall in the inner cavity and is inclined with respect to the longitudinal axis of the first tubular member;

(b) a second tubular member slidably mounted in the first tubular member so as to be along the longitudinal axis and having a first end and a second end and at least one wall between the ends forming an inner cavity, wherein a second cam surface is provided on at least one wall in the inner cavity of the second tubular member along the axis and is inclined with respect to the longitudinal axis of the first tubular member, wherein the first and second cam surfaces are oppositely inclined with respect to the longitudinal axis and wherein at least one of the second or first tubular members is movable along the longitudinal axis relative to the other of the tubular members to move the tubular members together;

(c) cam follower means mounted on and between the first and second cam surfaces, wherein the cam follower means moves on both cam surfaces simultaneously as the tubular members are moved together; and (d) resilient means having opposed ends and mounted along and around the longitudinal axis of the tubular members so as to bias the tubular members apart and wherein the resilient means is shortened in length between the ends when the tubular members are moved together.

2. The counterbalance apparatus of claim 1 wherein the first and second cam surfaces are formed by a pair of first inserts and a pair of second inserts which are mounted in the inner cavities of the first and second members, respectively.

3. The counterbalance apparatus of claim 1 wherein a pair of torque compensation rollers are mounted on the second end of the second member and wherein the pair of first inserts have guide surfaces parallel to the longitudinal axis and wherein the torque compensation rollers move along and are in contact with the guide surfaces to assist in moving the first and second members together.

4. The counterbalance apparatus of claim 1 wherein the first and second cam surfaces are inclined so as to provide increasing leverage so that a relatively constant force can be applied between the ends of the tubular members which are distal to each other to move the tubular members together.

5. The counterbalance apparatus of any one of claims 1, 2 or 3 wherein a dampening means having opposed ends is mounted at one end on one of the ends of the second tubular member with the cam follower means mounted at the other one of the ends of the dampening means.

6. The counterbalance apparatus of claim 5 wherein an adjustment means is mounted on the dampening means for varying a length of and compression of the resilient means mounted around the dampening means.

7. The counterbalance apparatus of any one of claims 1, 2 or 3 wherein a dampening means having opposed ends is mounted at one end on one of the ends of the second tubular member with the cam follower means mounted at the other end of the dampening means and wherein the resilient means is a series of three coil springs mounted inside of the second tubular member and around the dampening means so as to bias the tubular members apart.

8. The counterbalance apparatus of any one of claims 1, 2 or 3 wherein a dampening means having opposed ends is mounted at one end on one of the ends of the second tubular member with the cam follower means mounted at the other end of the dampening means, wherein the resilient means is a series of three coil springs mounted inside of the second tubular member and around the dampening means so as to bias the tubular members apart and wherein the coil springs have non-linear coils along a length of the coil springs so as to require a variable force to compress the coil springs along the length.

9. The counterbalance apparatus of any one of claims 1, 2 or 3 wherein a dampening means having opposed ends is mounted at one end on one of the ends of the second tubular member with the cam follower means mounted at the other end of the dampening means, wherein the resilient means is a series of coil springs mounted inside of the second tubular member and around the dampening means so as to bias the tubular members apart and wherein an adjustment means is mounted on the dampening means for varying a length and thus compression of the coil springs when the tubular members are biased apart.

10. The counterbalance apparatus of any one of claims 1, 2 or 3 wherein a dampening means having opposed ends is mounted at one end on one of the ends of the second tubular member with the cam follower means mounted at the other of the ends of the dampening means, wherein the resilient means includes several coil springs mounted inside of the second tubular member and around the dampening means so as to bias the tubular members apart and wherein the coil springs have non-linear coils along a length of the coil springs so as to require a variable force to compress the coil springs along the length and wherein an adjustment means is mounted on the dampening means for varying the length of and thus compression of the coil springs when the tubular members are biased apart.

11. The counterbalance apparatus of any one of claims 1, 2 or 3 wherein a dampening means having opposed ends is mounted at one end on one of the ends of the second tubular member with the cam follower means mounted at the other of the ends of the dampening means wherein the resilient means is provided by several coil springs and is mounted inside of the second tubular member and around the dampening means to bias the tubular members apart and wherein an adjustment means is mounted on the dampening means for varying a length of and thus compression of the coil springs when the tubular members are biased apart.

12. The counterbalance apparatus of any one of claims 1, 2 or 3 wherein a dampening means having opposed ends is mounted at one of the ends on one of the ends of the second tubular member with the cam follower means mounted at the other one of the ends of the dampening means, wherein the resilient means is provided by several coil springs mounted inside of the second tubular member and around the dampening means so as to bias the tubular members apart and wherein a rotatable adjustment means for compression or decompression of the coil springs is provided by a threaded member on the dampening means and a threaded retaining means mounted on the threaded member, the threaded retaining means having a projection which movably engages a longitudinally oriented portion of at least one wall of the second tubular member.

13. The counterbalance apparatus of any one of claims 1, 2 or 3 wherein a dampening means having opposed ends is mounted at one of the ends on one of the ends of the second tubular member with the cam follower means mounted at the other of the ends of the dampening means, and wherein the resilient means is a series of three coil springs mounted inside of the second tubular member and around the dampening means to bias the tubular members apart, wherein the coil springs have non-linear coils along a length of the coil spring means so as to require a variable force to compress the coil spring means along the length, wherein a rotatable adjustment means for compression or decompression of the coil spring means is mounted on the dampening means for varying the length of the coil spring means when the tubular members are biased apart, wherein the adjustment means is provided by a threaded member on the dampening means and a threaded retaining means mounted on the threaded member, the threaded retaining means having a projection which engages a longitudinally oriented portion of at least one wall of the second tubular member and wherein the ends of the coil springs are mounted between the retaining means and the cam follower means.

14. The counterbalance apparatus of claims 1, 2 or 3 wherein the second and first tubular members have a circular cross-section.

15. The apparatus of claims 1, 2 or 3 wherein multiple of the first and second cam surfaces and the cam follower means are provided on the tubular members around the longitudinal axis.

16. The apparatus of claims 1, 2 or 3 wherein a dampening means having opposed ends is mounted at one end on one of the ends of the second tubular member with the cam follower means mounted at the other end of the dampening means, and wherein the resilient means is a series of three coil springs mounted inside of the second tubular member and around the dampening means to bias the tubular members apart, wherein the coil springs have non-linear coils which require a variable force to compress the coil springs along a length of the coil springs, wherein a rotatable adjustment means for compression or decompression of the coil springs is mounted on the dampening means for varying the length of the coil springs when the tubular members are biased apart, and wherein the adjustment means is provided by a threaded member on the dampening means and a threaded retaining means mounted on the threaded member, the retaining means having a projection which engages the second tubular member, wherein the coil springs have ends which are mounted between the retaining means and the cam follower means and wherein the second and first tubular members have a circular cross-section.

17. The counterbalance apparatus of claims 1, 2 or 3 wherein a pair of anti-cantilever rollers are mounted on the second end of the second member perpendicular to the longitudinal axis and adjacent to the wall of the first tubular member to prevent cantilevering of the second tubular member in the first tubular member.

18. A work station with a counterbalance movable work surface and a support means for the work surface with a counterbalance apparatus between the support means and the work surface for the movement which comprises:

(a) the counterbalance apparatus including a first tubular member defining a longitudinal axis and having a first end and a second end with at least one wall between the ends which forms the tubular member, wherein a first cam surface is provided on the wall and is inclined with respect to the longitudinal axis of the first tubular member; a second tubular member slidably mounted in the first tubular member so as to be along the axis and having a first end and a second end and at least one wall between the ends, wherein a second cam surface is provided on the wall along the axis and is inclined with respect to the longitudinal axis of the first tubular member, wherein the first and second cam surfaces are oppositely inclined with respect to the longitudinal axis and wherein at least one of the second or first tubular members is movable along the longitudinal axis relative to the other of the tubular members to move the tubular members together; cam follower means mounted on and between the first and second cam surfaces, wherein the cam follower means moves on both cam surfaces simultaneously as the tubular members are moved together; and resilient means with opposed ends which are mounted along and around the longitudinal axis of the first tubular member so as to bias the tubular members apart and which is shortened in length between the ends of the resilient means when the tubular members are moved together; and (b) locking means for securing the work surface of the work station against movement.

19. The counterbalance apparatus of claim 18 wherein an anti-racking mechanism is mounted on the counterbalance apparatus and includes a first and second upper spool mounted on a shaft and a first lower spool and having a first strap wrapped around the first upper and lower spools and a second strap wrapped around the second upper spool wherein the straps are mounted on the upper spools such that when the upper spools rotate in the same direction, one of the straps winds around the upper spool and the other strap unwinds around the other upper spool.

20. The counterbalance apparatus of claim 19 wherein the first strap is wrapped around the first upper spool in a counter clockwise direction with one end of the strap extending downward around the lower spool in a counter clockwise direction and wherein an other end of the strap extends upward and is secured to the first end of the second tubular member such that as the second tubular member moves into the first tubular member, the first strap wraps around the first upper spool.

21. The counterbalance apparatus of claim 20 wherein the first lower spool is movable to allow for tensioning the first and second straps.

22. The counterbalance apparatus of claim 20 wherein the second strap is wrapped around the second upper spool in a clockwise direction with one end of the second strap extending downward and is secured to the second end of the second tubular member such that as the second tubular member moves into the first tubular member, the second strap unwinds from around the second upper spool.

23. The counterbalance apparatus of claim 19 wherein the spools are mounted adjacent a first end of the first tubular member.

24. The counterbalance apparatus of claim 19 wherein the work station has a second counterbalance apparatus, the shaft having the upper spool connected to a shaft of an anti-racking mechanism of the second counterbalance apparatus such as to align the two counterbalance apparatuses during movement.

25. In a counterbalance apparatus, the improvement which comprises:

(a) a first tubular member defining a longitudinal axis and having a first end and a second end with at least one wall between the ends which forms the tubular member having an inner cavity, wherein a first cam surface is provided on at least one wall in the inner cavity and is inclined with respect to the longitudinal axis of the first tubular member;

(b) a second tubular member slidably mounted in the first tubular member so as to be along the axis and having a first end and a second end and at least one wall between the ends forming an inner cavity, wherein a second cam surface is provided on at least one wall in the inner cavity of the second tubular member along the axis and is inclined with respect to the longitudinal axis of the first tubular member, wherein the first and second cam surfaces are oppositely inclined with respect to the longitudinal axis and wherein at least one of the second or first tubular members is movable along the longitudinal axis relative to the other of the tubular members to move the tubular members together;

(c) cam follower mounted on and between the first and second cam surfaces, wherein the cam follower moves on both cam surfaces simultaneously as the tubular members are moved together; and (d) force storage mechanism with opposed ends which is mounted along and around the longitudinal axis of the tubular members so as to bias the tubular members apart.

26. The counterbalance apparatus of claim 25 wherein the first and second cam surfaces are inclined so as to provide increasing leverage so that a relatively constant force can be applied between the ends of the tubular members which are distal to each other to move the tubular members together.

27. The counterbalance apparatus of any one of claims 25 or 26 wherein a dampener having opposed ends is mounted at one end on one of the ends of the second tubular member with the cam follower mounted at the other one of the ends of the dampener.

28. The counterbalance apparatus of any one of claims 25 or 26 wherein a dampener having opposed ends is mounted at one end on one of the ends of the second tubular member with the cam follower mounted at the other end of the dampener and wherein the force storage mechanism is a coil spring mounted inside of the second tubular member and around the dampener so as to bias the tubular members apart.

29. The counterbalance apparatus of any one of claims 25 or 26 wherein a dampener having opposed ends is mounted at one end on one of the ends of the second tubular member with the cam follower mounted at the other end of the dampener, wherein the force storage mechanism is a series of three coil springs mounted inside of the second tubular member and around the dampener so as to bias the tubular members apart and wherein the coil springs have non-linear coils along a length of the coil springs so as to require a variable force to compress the coil springs along the length.

30. The counterbalance apparatus of any one of claims 25 or 26 wherein an adjuster is mounted on the dampener for varying a length of and thus compression of the force storage mechanism mounted around the dampener.

31. The counterbalance apparatus of any one of claims 25 or 26 wherein a dampener having opposed ends is mounted at one end on one of the ends of the second tubular member with the cam follower mounted at the other end of the dampener and wherein an adjuster is mounted on the dampener for varying a length of and thus compression of the force storage mechanism mounted between the end of the second tubular member and the cam follower which biases the tubular members apart.

* * * * *

UNITED STATES PATENT AND TRADEMARK OFFICE

CERTIFICATE OF CORRECTION

PATENT NO. : 6,378,446 B1
DATED : April 30, 2002
INVENTOR(S) : Dennis L. Long

It is certified that error appears in the above-identified patent and that said Letters Patent is hereby corrected as shown below:

Column 2,
Line 13, "Gutqsell" should be -- Gutgsell --.
Line 26, "Gutqsell" should be -- Gutgsell --.

Column 12,
Line 42, "surface 110B" should be -- surface 100B --.

Column 15,
Line 30, the equation as printed:

$$X = \frac{\left(Y - \frac{1}{K}\left[1 - e^{-KT}\right]\right)}{M}$$

Should be replaced with the following equation:

$$X = \frac{\left(Y - \frac{1}{K}\left[1 - e^{-KT}\right]\right)}{M}$$

Signed and Sealed this

Fifth Day of November, 2002

*Attest:*

*Attesting Officer*

JAMES E. ROGAN
*Director of the United States Patent and Trademark Office*